US008407879B1

(12) United States Patent
Glaspell

(10) Patent No.: US 8,407,879 B1
(45) Date of Patent: Apr. 2, 2013

(54) APPLICATOR FILLING/ASSEMBLY METHOD

(75) Inventor: John S. Glaspell, Erie, PA (US)

(73) Assignee: Plastek Industries, Inc., Erie, PA (US)

( * ) Notice: Subject to any disclaimer, the term of this patent is extended or adjusted under 35 U.S.C. 154(b) by 495 days.

(21) Appl. No.: 12/704,080

(22) Filed: Feb. 11, 2010

Related U.S. Application Data

(60) Provisional application No. 61/151,671, filed on Feb. 11, 2009.

(51) Int. Cl.
*B23Q 3/00* (2006.01)
*B23P 19/00* (2006.01)

(52) U.S. Cl. ..... 29/464; 29/466; 29/801; 29/700; 29/271; 29/281.5; 29/281.1; 401/265

(58) Field of Classification Search ..... 29/464, 29/466, 801, 700, 271, 281.1, 281.5, 281.6; 401/175, 265, 277, 286, 292
See application file for complete search history.

(56) References Cited

U.S. PATENT DOCUMENTS 3,565,161 A * 2/1971 Lindsey ..... 164/312
4,197,627 A * 4/1980 Hirabayashi et al. ..... 29/281.5
5,385,481 A * 1/1995 Kotyuk ..... 439/378
5,548,943 A * 8/1996 Behar et al. ..... 53/473
5,767,596 A * 6/1998 Stark et al. ..... 310/89
5,806,161 A * 9/1998 Schneider ..... 29/271
5,913,398 A * 6/1999 Murata et al. ..... 192/107 C
5,984,653 A * 11/1999 Misiak ..... 418/55.1
6,039,483 A 3/2000 Szekely
6,572,300 B2 * 6/2003 Altonen et al. ..... 401/266
6,688,793 B2 * 2/2004 Goyet ..... 401/175
7,578,319 B2 * 8/2009 Behar et al. ..... 141/2
8,057,118 B2 * 11/2011 Yuhas ..... 401/265
8,156,629 B2 * 4/2012 Ceelen ..... 29/464
2001/0011649 A1 * 8/2001 Fujie et al. ..... 215/256
2002/0048483 A1 * 4/2002 Altonen et al. ..... 401/266

* cited by examiner

*Primary Examiner* — Essama Omgba
(74) *Attorney, Agent, or Firm* — Bachman & LaPointe, P.C.

(57) ABSTRACT

In a method for assembling a dispenser/applicator, a closure/applicator is assembled over an applicator body. The applicator body contains a body of personal care product. A seal is applied over the closure/applicator. A cap is assembled over the closure/applicator. The closure/applicator may be installed with a plurality of pins protruding through apertures in the closure/applicator. The pins may guide an end of an elevator screw into a complementary boss of the closure/applicator.

8 Claims, 4 Drawing Sheets

APPLICATOR FILLING/ASSEMBLY METHOD

CROSS-REFERENCE TO RELATED APPLICATIONS

Benefit is claimed of U.S. Patent Application Ser. No. 61/151,671, filed Feb. 11, 2009, and entitled "Applicator Filling/Assembly Method", the disclosure of which is incorporated by reference herein in its entirety as if set forth at length.

BACKGROUND OF THE INVENTION

The invention relates to personal care. More particularly, the invention relates to applicators for underarm antiperspirant and/or deodorant.

A well-developed art exists regarding dispenser/applicators for personal care products. One particular area involves applicators for solid or gel antiperspirant and/or deodorant compositions. Applicators for solid and gel compositions are typically thoroughly similar to each other, with a piston (platform) upwardly movable within a cylinder (barrel) to progressively drive the composition out the barrel upper end. Due to the relative lack of stiffness of many gels and soft solids, dispensers for such compositions commonly include apertured applicator elements across the upper end of the barrel.

One dispenser/applicator is disclosed in U.S. Pat. No. 6,039,483 (the '483 patent) entitled Rotary Dispenser, the disclosure of which is incorporated by reference herein in its entirety as if set forth at length.

SUMMARY OF THE INVENTION

One aspect of the disclosure involves the method for assembling a dispenser. A closure/applicator is assembled over an applicator body. The applicator body contains a body of personal care product. A seal is applied over the closure/applicator. A cap is assembled over the closure/applicator. The closure/applicator may be installed with a plurality of pins protruding through apertures in the closure/applicator. The pins may guide an end of an elevator screw into a complementary boss of the closure/applicator.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
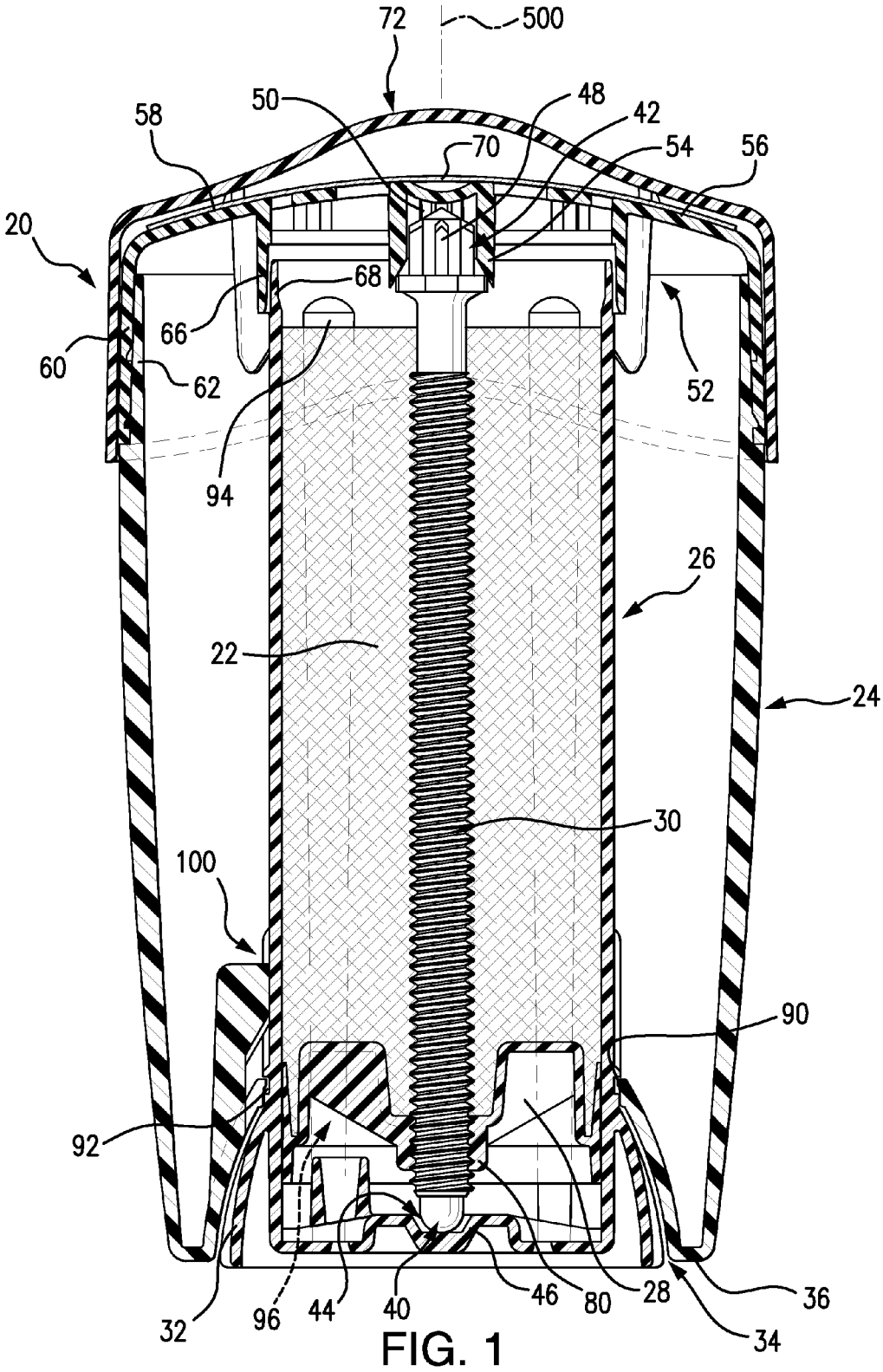
FIG. 1 is a transverse longitudinal/vertical section view of a personal care product dispenser/applicator in an as-manufactured pre-use condition.
Figure 2:
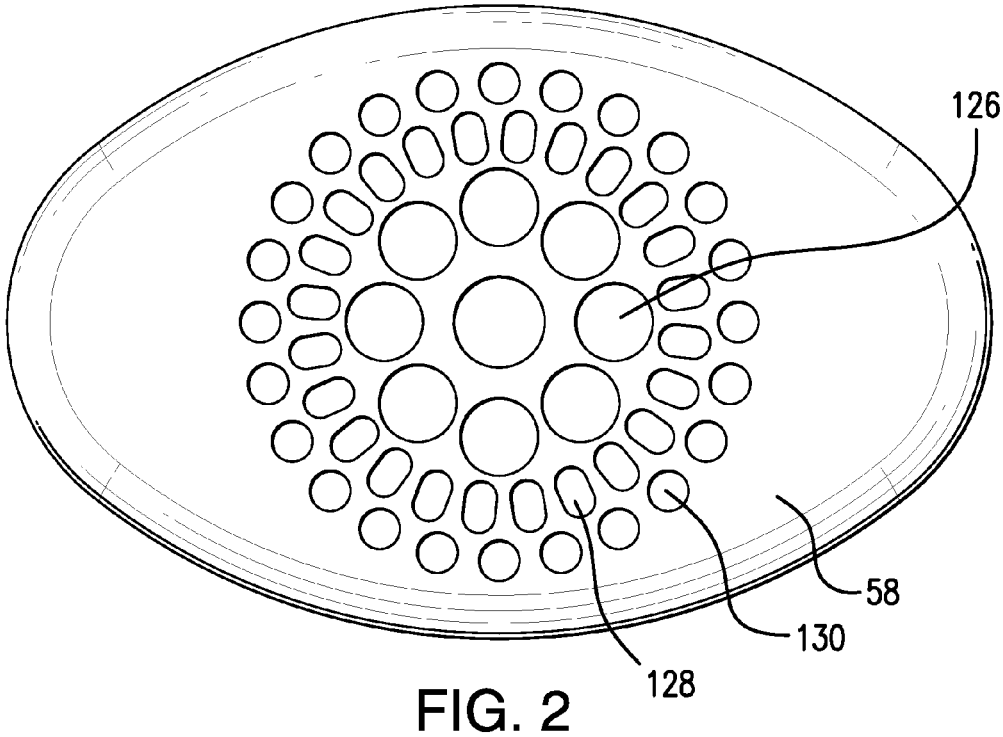
FIG. 2 is a top view of an applicator/dome of the dispenser/applicator of FIG. 1.
Figure 3:
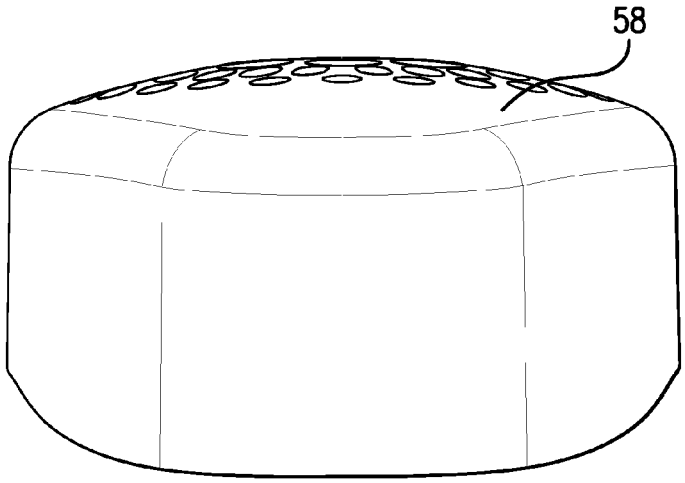
FIG. 3 is a side view of the applicator/dome of FIG. 2.
Figure 4:
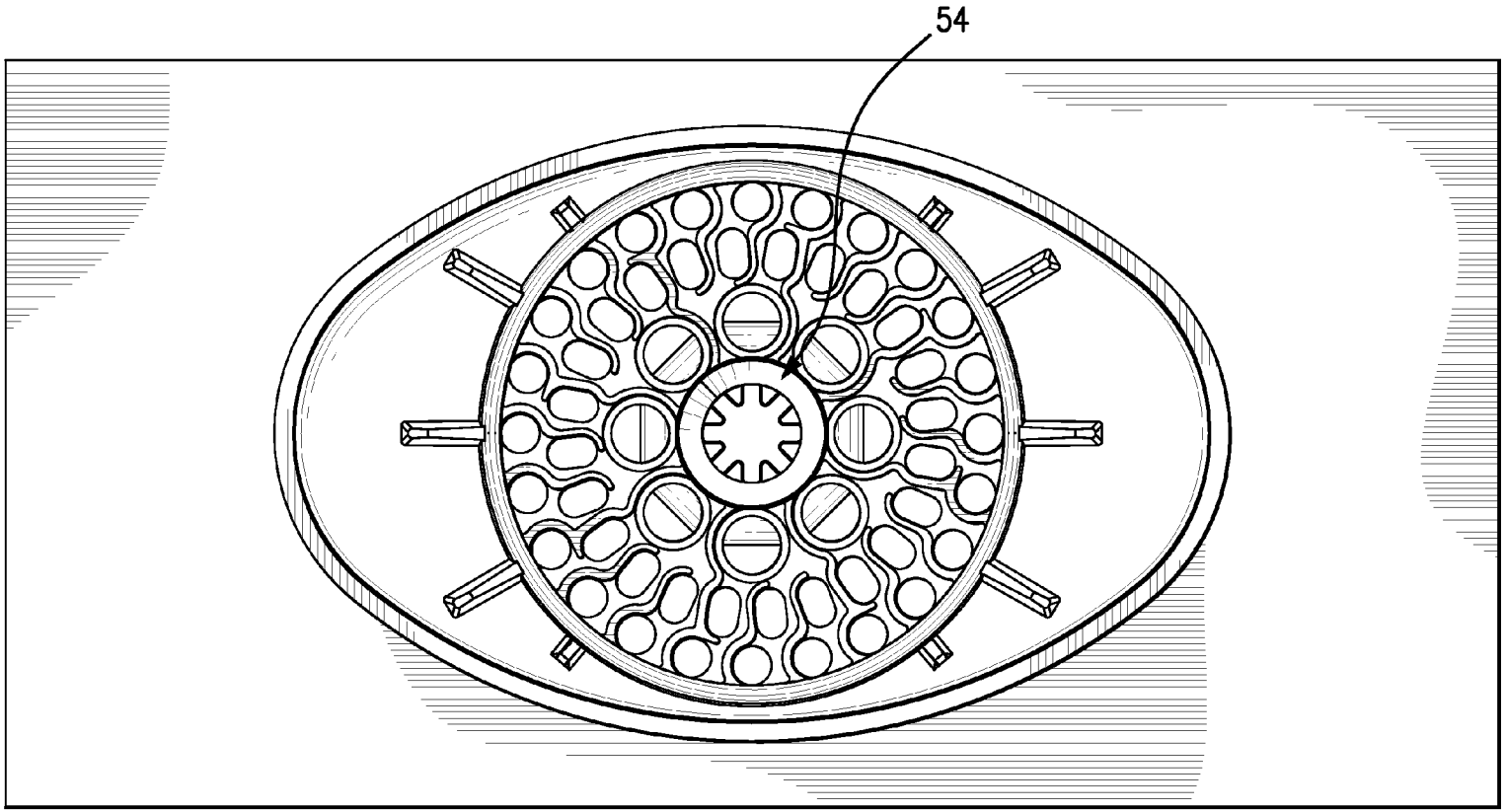
FIG. 4 is a bottom view of the applicator/dome installed to a dispenser/applicator assembly fixture.

FIG. 1 shows a dispenser 20 (often referred to as an applicator) for a personal care product 22 (e.g., a cream, gel, or soft/semi-solid antiperspirant and/or deodorant). The dispenser 20 includes a body having an outer member 24 (often identified as a barrel) and an inner member 26 (often identified as a cartridge). The inner member 26 directly contains the product 22. The inner member and outer member each are formed as a single piece molding. The inner member carries a platform or piston 28 and an elevator screw 30 for raising the platform to eject the product. A lower end portion 32 of the inner member forms a knob accommodated within a well 34 extending upward from a base 36 in the outer member 24. The well is open front-and-back to allow grasping of the knob 32 by a user's fingers to rotate the inner member 26. The exemplary elevator screw 30 extends from a lower end portion 40 to an upper end portion 42. The exemplary lower end portion 40 is smooth and received in a complementary compartment 44 in the base 46 of the inner member 26. This permits the inner member to rotate relative to the screw about a screw axis 500 which forms the central longitudinal axis of the dispenser 20.

The upper portion 42 has anti-rotation features (e.g., radially-projecting longitudinal fins or teeth 48). The teeth 48 interfit with complementary features (e.g., teeth/channels, or the like 50 of a closure applicator/dome 52). The exemplary features 50 are formed in an inner boss 54 which depends from an upper applicator portion 56. The applicator portion 56 has a smooth outer surface 58 for spreading the product. In operation, the product is ejected through holes in the applicator portion 56. The exemplary dome 52 has an outer sidewall 60 which receives a mating upper portion 62 of the outer member sidewall. The applicator also has an intermediate boss 66 which receives an upper portion 68 of the inner member sidewall. In a pre-use condition, a foil or plastic seal 70 may be secured along the outer surface 58 and a cap/cover 72 may be secured over the dome (e.g., in an easily reversible (e.g., slightly detented) snap fit).

The platform 28 has an internally threaded boss 80 in threaded engagement with the threads of the elevator screw. The inner member 26 is axially retained relative to the outer member 24 via interfitting features such as an inwardly projecting rib 90 of the outer member engaging an outwardly open channel 92 of the inner member.

Orientation of the piston relative to the inner member about the axis 500 is maintained by appropriate interfitting features (e.g., channels 94 in the inner surface of the sidewall engaging axial ribs 96 along the outer surface of the piston). The features of the inner and outer members may form a detent mechanism 100 for detenting rotation of the knob.

In operation, after the seal 70 has been removed, the user rotates the knob 32 relative to the outer body 24. With the interfitting features 48, 50 retaining the elevator screw relative to the dome (and inner and outer bodies), and with the piston orientation maintained relative to the inner body 26, this produces a rotation of the piston relative to the screw. Rotation in one direction will tend to raise the piston toward the dome, thereby ejecting product through the holes. The rib 90 and channel 92 prevent the pressure from axially displacing the inner member.

FIGS. 1-4 show a slightly modified dome relative to that of the '483 patent. Assembly may be otherwise as described in the '483 patent. However, after the inner housing and outer housing are assembled and after the inner housing is filled with personal care product (either before or after said assembly), the present method may differ.

In an exemplary sequence of operation, the individual components are manufactured (e.g., via conventional techniques such as injection molding of appropriate plastics). The piston may be installed proximate the lower end of the elevator screw and this subassembly assembled into the inner body. The inner body may be filled with the product (e.g., heated and poured in through the open upper end of the body and allowed to cool/partially solidify). The inner body may then be inserted into the outer body (e.g., snapped in place until the features 90 and 92 engage). Alternatively, these mechanical assembly steps may be performed prior to introducing the product.

Figure 5:
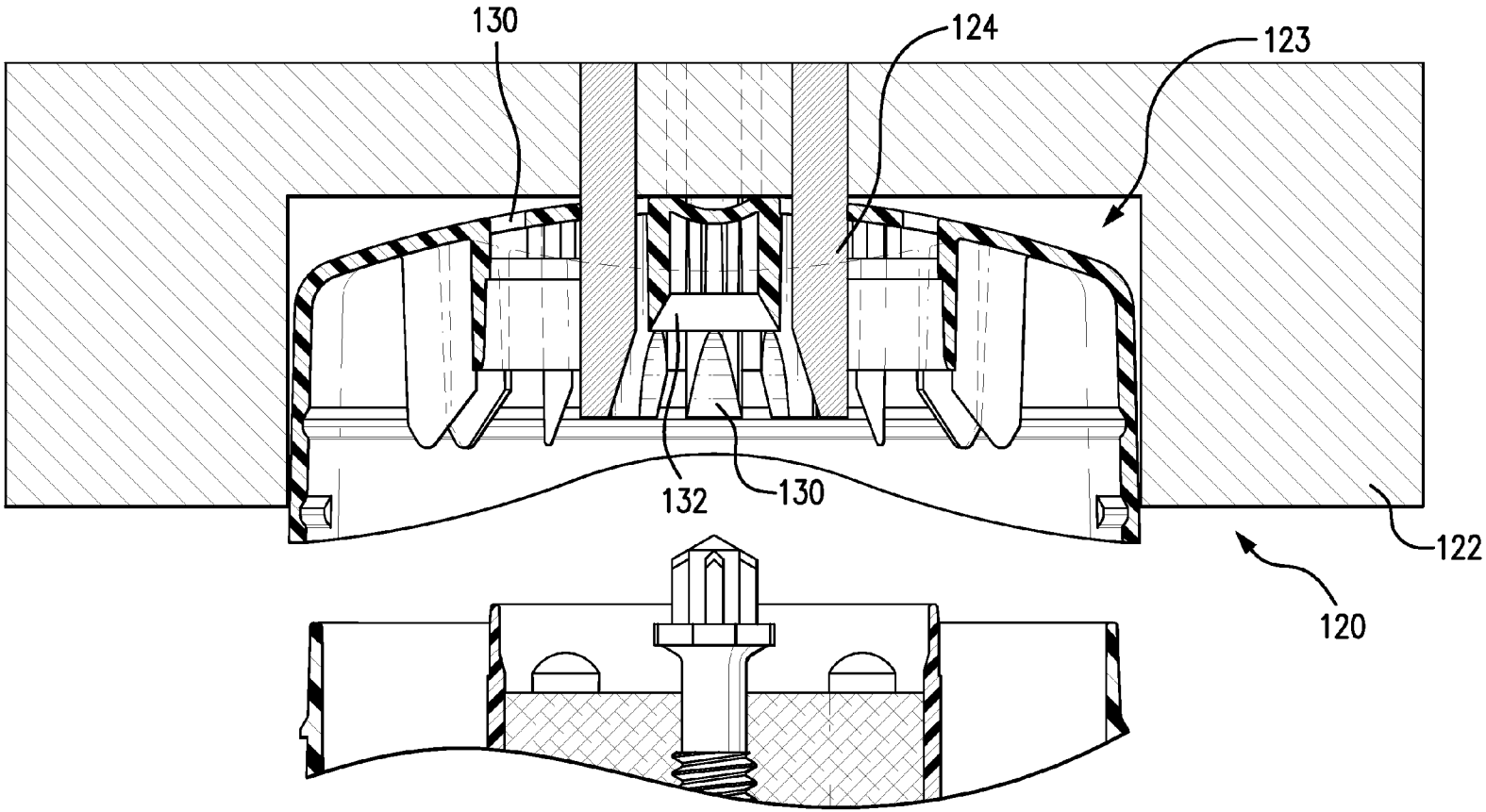
FIG. 5 is a partial transverse longitudinal/vertical sectional view of the fixture and applicator/dome during installation.

However, the present dome 52 is installed without the foil seal 70 on its upper surface 58. The foil seal may be installed after dome installation. The dome is installed to the assembled housing members (dispenser/applicator body) by a fixture 120 (FIG. 5) having a fixture body 122 which has a well/compartment 123 that holds the dome 52. The fixture further includes a group of pins 124 which extend through corresponding apertures in the dome upper surface (e.g., the slots of the '483 patent or, as shown, a circular array of circular apertures 126 (FIG. 2)). The exemplary dome 52 has additional arrays of apertures 128 and 130. The exemplary apertures 126 are larger than the other apertures and relatively radially inboard to accommodate the pins. The additional apertures are relatively outboard and may be sized and arranged for optimal distribution of product.

During the dome installation, the pins help guide the externally toothed or faceted upper end 42 of the elevator screw (threaded member) into engagement with the internally toothed or faceted boss 54 depending from the underside of the dome. This prevents an assembly error wherein a slightly off-center screw misses the boss and is sufficiently misaligned with the boss to be deflected to the side of the boss rather than into concentric engagement with the boss. The pins may have radially-inboard angled guide surfaces 130 (e.g., approximately continuing the taper 132 of a tapered mouth of the boss) to help further guide the elevator screw. After dome installation, the fixture may be removed (exemplary removal involves first retracting the pins out of the closure/applicator (e.g., via a retractor of the fixture (not shown)) and then disengaging the fixture body while the closure/applicator remains retained to the outer housing. Alternatively, the pins and fixture body may be disengaged as a unit. Thereafter, the foil seal may be installed (covering the apertures) and the cap/closure installed over the dome.

The pins may be separate pieces from each other or may be part of a single piece. Individual pins may be machined from rod stock (e.g., stainless steel). In an integral implementation, the fixture body may be machined from a metal (e.g., stainless steel) and the pins press-fit in place.

Use of the fixture may reduce the frequency of failures of the screw to properly engage the dome inner boss. This may reduce the frequency of defects that are noticed in inspection and defects that are noticed only upon attempted use. This may provide improved customer satisfaction even if the additional manufacturing costs outweigh the manufacturing cost of the avoided defective product.

One or more embodiments of the present invention have been described. Nevertheless, it will be understood that various modifications may be made without departing from the spirit and scope of the invention. For example, when implemented in the context of an existing applicator or a modification of an existing applicator, details of such existing applicator may influence details of any particular implementation. Accordingly, other embodiments are within the scope of the following claims.

What is claimed is:

1. A method for assembling a dispenser, the method comprising:

assembling a closure/applicator over an applicator body, the applicator body containing a body of a personal care product;

applying a seal over the closure/applicator; and assembling a cap over the closure/applicator, wherein the closure/applicator is installed by a fixture having a fixture body which has a compartment configured to hold the closure/applicator, the fixture including a plurality of pins wherein during installation the closure/applicator is inserted in the compartment and the pins protrude through apertures in the closure/applicator, the pins guiding an end of an elevator screw into a complementary boss of the closure/applicator.

2. The method of claim 1 wherein:

the pins each have a guide surface positioned to guide the end of the elevator screw into the boss when the elevator screw is initially off-center.

3. The method of claim 1 further comprising:

retracting the pins out of the closure/applicator.

4. The method of claim 3 wherein the fixture has a refractor and wherein:

the retractor retracts the pins and, thereafter, a body of the fixture is disengaged from the dispenser.

5. The method of claim 1 wherein:

the personal care product is a cream or a gel.

6. The method of claim 1 wherein:

the applicator body comprises an inner housing and an outer housing.

7. The method of claim 1 wherein:

the pins each have a guide surface oriented to continue a taper of a tapered mouth of the boss.

8. The method of claim 1 wherein:

the applying of the seal covers the apertures.

* * * * *